United States Patent [19]

Tanaka et al.

[11] 4,362,802

[45] Dec. 7, 1982

[54] POWDERY DEVELOPING MATERIAL FOR ELECTROPHOTOGRAPHIC REPRODUCTION

[75] Inventors: Susumu Tanaka, Sakai; Koji Nagai; Sanzi Inagaki, both of Itami, all of Japan

[73] Assignee: Minolta Camera Kabushiki Kaisha, Osaka, Japan

[21] Appl. No.: 205,593

[22] Filed: Nov. 10, 1980

Related U.S. Application Data

[63] Continuation of Ser. No. 18,677, Mar. 8, 1979, abandoned.

[30] Foreign Application Priority Data

Mar. 17, 1978 [JP] Japan ..... 53-31204

[51] Int. Cl.[3] ..... G03G 9/14

[52] U.S. Cl. ..... 430/106.6; 430/107; 430/111; 430/903; 430/122; 252/62.54

[58] Field of Search ..... 430/111, 107, 106.6; 252/62.54

[56] References Cited

U.S. PATENT DOCUMENTS

| | | | |
|---|---|---|---|
| 3,349,703 | 10/1967 | Varrow et al. | 430/108 |
| 3,938,992 | 2/1976 | Jadwin | 430/110 |
| 3,942,979 | 3/1976 | Jones | 430/110 |
| 4,108,786 | 8/1978 | Takayama et al. | 430/110 |
| 4,111,823 | 9/1978 | Kobayashi et al. | 430/110 |
| 4,165,393 | 8/1979 | Suzuki et al. | 430/122 |

*Primary Examiner*—John D. Welsh

*Attorney, Agent, or Firm*—Wenderoth, Lind & Ponack

[57] ABSTRACT

A dry developing powder composition particularly suited for use in electrophotographic reproduction which comprises a magnetic toner of 35 to 50 microns in average particle size mixed with a non-magnetic toner of 5 to 30 microns in average particle size. The amount of the magnetic toner used is within the range of 85 to 98% by weight relative to the total weight of the composition and the amount of the non-magnetic toner used is within the range of 2 to 15% by weight relative to the total weight of the composition.

4 Claims, No Drawings

POWDERY DEVELOPING MATERIAL FOR ELECTROPHOTOGRAPHIC REPRODUCTION

This is a continuation application of Application Ser. No. 18,677, filed Mar. 8, 1979, now abandoned.

BACKGROUND OF THE INVENTION

The present invention generally relates to a powdery developing material and, more particularly, to a developer mix particularly suited for use in electrostatic image development.

The copending U.S. patent application Ser. No. 863,616, filed on Dec. 23, 1977, the invention of which has been assigned to the same assignee of the present invention, discloses a developer mix comprised of a mixture of a magnetic toner with a non-magnetic toner. The present invention pertains to an improvement of such a developer mix as disclosed and claimed in the copending application.

Where the developer mix consisting of the magnetic and non-magnetic toners is used in electrostatic image development to develop an electrostatic latent image, formed on a photoconductive support medium, into a powder or toner image, the non-magnetic and magnetic toners are deposited on the electrostatic latent image respectively by the action of electric charge triboelectrically charged thereto through friction with the magnetic toner and by the action of electric charge reverse in polarity to that of the electrostatic latent image and injected thereinto through an electroconductive dispensing sleeve in a manner similar to that disclosed in the U.S. Pat. No. 3,909,258, patented on Sept. 30, 1975. The subsequent transfer of the powder or toner image so formed on the photoconductive support medium in the manner described above is carried out by the utilization of a corona discharge satisfactorily.

The use of the developer mix of the composition described above has eliminated such problems inherent in the use of the toner-carrier developer mix, one type of two-component developer mix, as resulting from deterioration of the carrier particles which often takes place due to the fact that the carrier particles are not consumed in development of the electrostatic latent image in contrast to the toner particles and, therefore, repeatedly reused. Moreover, the use of the developer mix referred to above is advantageous in that the corona discharge can effectively be used in satisfactorily transferring the powder or toner image from the photoconductive support medium to a sheet of final support material, that is, a copying paper.

In the mixture of the magnetic toner with the non-magnetic toner, it has heretofore been considered appropriate and satisfactory that the magnetic toner particles have an average particle size within the range of 10 to 30 microns. By way of example, the U.S. Pat. No. 4,111,823, patented on Sept. 5, 1978, described that, if the average particle size of the magnetic toner particles is smaller than 10 microns, a satisfactory electrophotographic reproduction of an image can hardly be achieved and, if it is larger than 30 microns, the use of the developer mix will cause an uneven or rough resulting image. The selection of the range of the average particle size of the magnetic toner particles forming a part of the developer mix disclosed in the U.S. Pat. No. 4,111,823 appears to have been made in consideration of the fact that a fine resulting image can be obtained on a copying paper while it has been a practice to use the two-component developer mix having an average particle size within the range of 5 to 30 microns and, in the case of the magnetic toner, the addition of the magnetic toner particles has tended to increase the average particle size.

However, it has been found that the magnetic toner of 10 to 30 microns in average particle size does not necessarily result in satisfactory reproduction of an image of high quality when used in the development process carried under the following particular conditions.

(1) Where an original, the image of which is desired to be reproduced on a copying paper, contains a pale pattern and/or a very fine line, this pattern and/or line of the resultant image reproduced on the copying paper has been found more pale than the original pattern and/or line to such an extent that the reproduced pattern and/or line can hardly be recognizeable.

(2) When the number of revolutions of a magnet unit rotatably housed within the dispensing sleeve in a magnetic brush developing device had been reduced to 1,000 r.p.m. in an attempt to avoid any possible adverse effect which might result from heating evolved by an eddy current, it has been found that electrophotographic reproduction of an area image or a consecutive image results in the reproduced image having a continuous reduction in image contrast gradually decreasing from a front end of the image towards a rear end thereof, thereby lacking a high fidelity reproduction capability.

These problems (1) and (2) described above must be solved by all means to enable the copying machine to produce a satisfactory and acceptable reproduction of images. More specifically, so far as the problem (1) above is involved, in consideration of the fact that the copying machine is frequently used in making reproduction of documents containing letters, emphasis should be placed on improvement of the image concentration even though the reproductivity of a gradation of image may be sacrificed to such an extent that the high fidelity reproductivity of the image gradation will not be lowered, so that the resultant image of high contrast can be obtained in a readily recognizeable form. Therefore, in order to achieve this, the problem (1) above must be solved.

On the other hand, so far as the problem (2) above is involved, to reduce the number of revolution of the magnet unit within the dispensing sleeve is feasible since it can relieve the load imposed on other mechanisms of the copying machine, for example, reduction in motor torque, and since it enables the concurrent use of a drive source not only for driving other movable parts of the copying machine, but also for driving the magnet unit, and in order to assure this, a high fidelity reproduction is necessary. Therefore, the problem (2) above must be solved.

SUMMARY OF THE INVENTION

The present invention has been developed in consideration of the above described conditions under which the copying machine is used and is intended to provide an improved developer mix utilizable satisfactorily even under these conditions to achieve a high quality image reproduction.

The present inventors have explored the above described problems and, as a result thereof, have found that the problems (1) and (2) above can satisfactorily be solved by taking the following measures.

With respect to the problem (1) above, the increase in amount of the non-magnetic toner in its mixture with the magnetic toner to improve the image concentration tends to enhance deposition of toner particles on the surface of the dispensing sleeve during the running test, thereby constituting a cause for foggy image reproduction and deterioration of the image quality. Accordingly, it has been found feasible that the maximum permissible amount (30 wt%) of the non-magnetic toner to be mixed with the magnetic toner such as disclosed in the U.S. Pat. No. 4,111,823, referred to above, should be lowered down to 15 wt% relative to the total weight of the developer mix.

With respect to the problem (2), in view of the fact that the insufficient efficiency of motion of particles of the developer mix, that is, fluidity of the particles of the developer mix, is attributable, it has been found that not only the problem (2) above, but also the problem (1), can satisfactorily be solved by conducting a research as to the applicability of the developer mix wherein the average particle size of the magnetic toner exceeds the conventional range.

However, it has also been found that, if the average particle size of the magnetic toner particles used in the developer mix is larger than 50 microns, the gradation reproduction capability will be lowered to such an extent that the developer mix can be practically employed.

According to the present invention, the developer mix which can satisfactorily accomplish the above described objective comprises a magnetic toner having an average particle size within the range of 35 to 50 microns, which is mixed in an amount within the range of 85 to 98 wt% with 2 to 15 wt% of a non-magnetic toner having an average particle size within the range of 5 to 30 microns, the percent by weight being relative to the total weight of the developer mix.

Preferably, the respective amounts of the magnetic and non-magnetic toners to be mixed together are within the range of 90 to 95 wt% and within the range of 5 to 10 wt%.

Each of the magnetic and non-magnetic toners forming the developer mix of the present invention may be prepared from any known material so far as it is generally recognized as a material utlizable for the magnetic or non-magnetic toners. In addition, each of the magnetic and non-magnetic toners forming the developer mix of the present invention may contain any known coloring agent.

In order to render each of the magnetic and non-magnetic toners of the developer mix of the present invention to fall within the above described range, any known wind classifying device may be employed.

The reason that the use of the developer mix of the present invention containing the magnetic toner of an increased average particle size as compared with that of the prior art developer mix results in improvement of the image concentration and high fidelity reproduction of the image appears to reside in the increased magnetic moment and the increased electrode effect occurring at the developing station.

DETAILED DESCRIPTION OF THE INVENTION

The present invention will now be described by way of examples which are intended to illustrate the various embodiments of the present invention. It is to be noted that parts and ratios employed in the following description are by weight unless otherwise specified.

EXAMPLE I 100 parts of styrene-acrylic resin (identified by a tradename "HYMER-SMB73" manufactured by Sanyo Chemical Industries, Ltd., of Japan), 200 parts of finely divided magnetic material (identified by a tradename "MAGNETITE RB-BL" manufactured by Chitan Kogyo Kabushiki Kaisha of Japan) and 8 parts of a coloring agent (identified by a tradename "KETJEN BLACK EC" manufactured by the Lion Fat & Oil Co., Ltd., of Japan) were mixed together, then kneaded by the use of a heating roll and, after having been cooled, pulverized to provide four types of magnetic toners of 30 microns, 35 microns, 50 microns and 60 microns, respectively, in average particle size. These magnetic toners of 30 microns, 35 microns, 50 microns and 60 microns in average particle sizes are hereinafter referred to as magnetic toner-30, magnetic toner-35, magnetic toner-50 and magnetic toner 60, respectively.

Separately of the preparation of the magnetic toners, 100 parts of styrene-acrylic resin (identified by a tradename "PLIORITE ACL" manufactured by Good Year Chemical Industries, Ltd., of Japan), 8 parts of the same coloring agent as used in the magnetic toners referred to above and 1 part of a dye (identified by a tradename "NYGROSINE" manufactured by Orient Chemical Industries, Ltd., of Japan) were mixed, kneaded and pulverized, in a manner similar to the preparation of the magnetic toners, to provide a non-magnetic toner of 15 microns in average particle size.

In the following experiments, four types of developer mixes, respectively identified by Developer-A, Developer-B, Developer-C and Developer-D, were used. The Developer-A contains the magnetic toner-30 and the non-magnetic toner in a proportion of 9:1; the Developer-B contains the magnetic toner-35 and the non-magnetic toner in a proportion of 9:1; the Developer-C contains the magnetic toner-50 and the non-magnetic toner in a proportion of 9:1; and the Developer-D contains the magnetic toner-60 and the non-magnetic toner in a proportion of 9:1.

A copying machine used in the course of each of the following experiments is of a construction substantially disclosed in FIG. 3 of the earlier mentioned copending U.S. patent application Ser. No. 863,616, filed Dec. 23, 1977, the teachings of this patent being incorporated by reference herein. This copying machine generally comprises a photoconductive support medium in the form of a layer of a mixture of CdS and $CdCO_3$ which is supported on the outer peripheral surface of a drum rotatable in one direction past a plurality of processing stations including: a charging station at which the photoconductive support medium is electrostatically charged; an exposing station at which the charged photoconductive support medium is exposed imagewise to light projected by means of an optical projector system so that an electrostatic latent image can be formed on a local surface area of the photoconductive support medium in a pattern corresponding to the original image to be reproduced; a developing station at which the electrostatic latent image can be developed into a powder image by contacting particles of the developer mix by means of a magnetic brush onto the photoconductive support medium; a transfer station at which the powder image on the photoconductive support medium is transferred to a sheet of final support material by the utilization of a corono discharge; a cleaning station at which residue of the developer mix on the photoconductive support medium is removed; and an erasing station at which the electrostatic residue on the photoconductive support medium is erased. The copying machine further comprises a cascade developing unit of any known construction including a rotatably supported magnet unit housed within a dispensing sleeve fixedly supported in position with its outer peripheral surface spaced a minimum distance from the surface of the photoconductive support medium.

In the practice of each of the following experiments, the copying machine had been adjusted such that the electrostatic latent image had a maximum potential of −750 volt and a minimum potential of −150 volt, and the magnet unit was rotated at 1,000 r.p.m. and was of a type capable of exerting a magnetic force of 650 gauss on the outer peripheral surface of the dispensing sleeve spaced the minimum distance of 0.7 mm. from the photoconductive support medium.

Experiment 1

The original containing somewhat pale printed letters was electrophotographically reproduced on a copying paper and the image concentration of the resulting image on the copying paper was examined.

Experiment 2

The original containing an area image was electrophotographically reproduced on a copying paper and the reproductivity (X) of the image and the smoothness (Y) of the reproduced image were examined.

Experiment 3

The gradation of the reproduced image was examined by the use of a gray scale 10 step method (9-13, tradename of Eastman Kodak Co. of U.S.A.).

Experiment 4

The resolution was examined by the use of a test chart containing 10 lines per millimeter.

Experiment 5

The original containing a black-colored image was electrophotographically reproduced and the reflective concentration was examined at that time.

The respective results of the Experiments 1 to 5 are tabulated in Table I below.

TABLE I

| No. of Expts. | Type of Developer Mixes A | B | C | D |
|---|---|---|---|---|
| 1 | Somewhat low. Hard to read. | High Easy to read. | High Easy to read. | High Easy to read. |
| 2 (X) | Uneven. | Uniform. | Uniform. | Uniform. |
| (Y) | Acceptable. | Acceptable. | Acceptable. | Somewhat rough. |
| 3 | 7–8 step (soft) | 6 step (somewhat hard) | 6 step (somewhat hard) | Lower than 4 step. (hard) |
| 4 | 10 lines/mm. | 9 lines/mm. | 8 lines/mm. | about 6 lines/mm. |
| 5 | 1.0 | 1.2 | 1.4 | 1.4 |

From the above Table I, it will readily be seen that, so far as the image concentration (Expt. 1) and the image reproductivity (Expt. 2) are involved, the Developer-B, the Developer-C and the Developer-D have shown an excellent result and, so far as the smoothness of the reproduced image (Expt. 2(Y)) and the resolution (Expt. 4) are involved, the Developer-A, the Developer-B and the Developer-C have shown an excellent result. With respect to the gradation (Expt. 3), although the use of any one of the Developer-B and the Developer-C has resulted in the reproduction of the somewhat hard image, the both can sufficiently be used in the electrophotographic reproduction of such an original as having an image of continuous gradation. In addition, the measurement of the reflective concentration (Expt. 5) has shown that a larger average particle size of the developer mix results in a higher image concentration.

EXAMPLE II

Experiments similar to that under Example I were conducted with the copying machine operated under the same conditions as in Example I, by the use of any one of the Developer-B and the Developer C, the mixing ratio of which is varied as shown in the following Tables II and III.

From each of the Tables II and III, it will readily be seen that, so far as the image concentration (Expt. 1) is involved, any one of the Developer-B and Developer-C, which contains the non-magnetic toner in an amount of either 5 wt% or 15 wt% relative to the total weight of the developer mix is satisfactory.

TABLE II

| No. of Expts. | Mixing Ratio of Developer-B (wt %) (Non-magnetic Toner:Magnetic Toner) 5:95 | 15:85 |
|---|---|---|
| 1 | High. Easy to read. | High. Easy to read. |
| 2 (X) | Somewhat uneven. | Uniform. |
| (Y) | Acceptable. | Acceptable. |
| 3 | 7–8 step (soft) | 5 step (very hard) |
| 4 | 9 lines/mm. | 7 lines/mm. |
| 5 | 1.1 | 1.4 |

TABLE III

| No. of Expts. | Mixing Ratio of Developer-C (wt %) (Non-magnetic Toner:Magnetic Toner) 5:95 | 15:85 |
|---|---|---|
| 1 | High. Easy to read. | High. Easy to read. |
| 2 (X) | Uniform. | Uniform. |
| (Y) | Somewhat rough. | Acceptable. |
| 3 | 6 step (somewhat hard) | 5 step (very hard) |
| 4 | 8 lines/mm. | 6–7 lines/mm. |
| 5 | 1.4 | 1.4 |

Although the Developer-B and Developer-C each containing the non-magnetic toner in an amount of 5 wt% have resulted in the somewhat uneven reproductivity (Expt. 2(X)) and the somewhat rough reproduced image (Expt. 2(Y)), respectively, the both can satisfactorily be used in the electrophotographic reproduction. In addition, even though any one of the Developer-B and Developer-C each containing the non-magnetic toner in an amount of 15 wt% has resulted the reproduction of the very hard image (Expt. 3), the both can satisfactorily be used in the electrophotographic reproduction of such an original as having a image of continuous gradation.

So far as the resolution is involved (Expt. 4), it has been found that, in both Developer-B and Developer-C, a smaller amount of the non-magnetic toner mixed with the magnetic toner is preferred to give an excellent result. However, the minimum permissible amount of the non-magnetic toner should not be less than 2 wt%, or otherwise the resultant developer mix will not give a favorable image reproductivity and smoothness and, therefore, will no longer be practically applicable. On the other hand, if the amount of the non-magnetic toner to be mixed with the magnetic toner in each of the Developer-B and the Developer-C is excessive, not only will reproduction of the rough image resulting from scattering of the toner particles be enhanced, but also deposition of toner particles on the surface of the dispensing sleeve during the running test will be enhanced, thereby constituting a cause for foggy image reproduction and deterioration of the image quality. Therefore, the maximum permissible amount of the non-magnetic toner to be mixed with the magnetic toner should be about 15 wt%.

It is to be noted that the developer mix according to the present invention can exhibit a satisfactory and effective utility even if the magnetic toner having a volume resistivity within the range of $10^5$ to $10^{14}$ Ω.cm. is used in admixture with the non-magnetic toner.

Although the present invention has fully been described by way of the illustrative examples, it is to be noted that various changes and modifications are apparent to those skilled in the art, such changes and modifications being to be understood as included within the true scope of the present invention unless they depart therefrom.

What is claimed is:

1. A dry developing powder composition for use in a rotating magnetic brush developing apparatus consisting essentially of (A) 85 to 98 wt% of a magnetic toner capable of functioning as a developer comprising a mixture of a styrene-acrylic resin, magnetite in a finely divided state, and a coloring agent; and (B) 2% to 15% of a non-magnetic toner comprising a mixture of a styrene-acrylic resin and a coloring agent, said percentages being based on the total weight of the composition, said magnetic toner (A) and non-magnetic toner (B) being produced by mixing together the components making up each individual mixture (A) and (B), kneading the mixture by use of a heating roll, cooling the mixture and pulverizing each of said magnetic toner mixtures (A) and non-magnetic toner (B) thus-produced so that said magnetic toner has an average particle size within the range of 35 to 50 microns and said non-magnetic toner has an average particle size within the range of 5 to 30 microns.

2. A dry developing powder composition as claimed in claim 1, wherein the respective amounts of the magnetic and non-magnetic toners are within the range of 90 to 95% and within the range of 5 to 10%.

3. A dry developing powder composition according to claim 1 wherein the magnetic toner comprises 100 parts by weight of resin, 200 parts by weight magnetite, and 8 parts by weight of coloring agent and wherein the non-magnetic toner contains 100 parts by weight of resin and 8 parts by weight of the coloring agent.

4. In a dry magnetic brush developing process involving the use of a brush developing apparatus of a magnetic rotating type containing a rotary magnetic unit rotatably enclosed in a developing sleeve, comprising electrostatically charging a photoconductive support medium, forming an electrostatic latent image on the photoconductive support medium in a pattern corresponding to the original image to be produced, contacting the photoconductive support medium with a dry developing powder by means of said magnetic brush in which said developing powder is moved to the counter surface of said developing sleeve by the rotation of said rotary magnetic unit so as to be in contact with said photoconductive support medium, thereby developing the electrostatic latent image into a powder image and transferring the powder image onto a final support material, the improvement wherein the dry developing powder consists essentially of (A) a magnetic toner capable of functioning as a developer comprising a resin, a finely divided magnetic material and a coloring agent, in an amount within the range of 85% to 95% and (B) a non-magnetic toner capable of being triboelectrically charged through mixing with said magnetic toner comprising a resin, a coloring agent and a dye, in an amount within the range of 2% to 15%, said percentages being based on the total weight of the powder composition, said magnetic toner (A) and non-magnetic toner (B) being produced by mixing together the components making up each individual mixture (A) and (B) kneading the mixture by use of a heating roll, cooling the mixture and pulverizing each of said magnetic toner mixture (A) and non-magnetic toner mixture (B) thus-produced so that said magnetic toner has an average particle size within the range of 35 to 50 microns and an electro-resistivity ranging from $10^5$ to $10^{14}$ Ω.cm., and wherein said non-magnetic toner has an average particle size within the range of 5 to 30 microns.

* * * * *